United States Patent [19]

Hill

[11] 4,084,519

[45] Apr. 18, 1978

[54] ANTI-BURGLAR WINDOW SHIELDING SYSTEM AND LATCH MECHANISM THEREFOR

[76] Inventor: Uldéric Sylvio Hill, P.O. Box 68, Rock Island, County of Stanstead, Canada

[21] Appl. No.: 680,965

[22] Filed: Apr. 27, 1976

[51] Int. Cl.[2] ..... G08B 13/04

[52] U.S. Cl. ..... 109/42; 109/18; 160/4

[58] Field of Search ..... 109/11, 14, 15, 17, 109/18, 41, 42, 31; 160/1-9; 49/21, 31

[56] References Cited

U.S. PATENT DOCUMENTS

| | | | |
|---|---|---|---|
| 1,172,311 | 2/1916 | Richter | 109/14 |
| 1,535,770 | 4/1925 | Gettell | 109/14 |
| 1,635,140 | 7/1927 | O'Brien | 109/15 X |

FOREIGN PATENT DOCUMENTS

| | | | |
|---|---|---|---|
| 1,282,837 | 12/1961 | France | 109/18 |
| 428,165 | 7/1967 | Switzerland | 109/14 |
| 296,144 | 8/1928 | United Kingdom | 109/18 |
| 375,208 | 6/1932 | United Kingdom | 160/3 |
| 392,935 | 5/1933 | United Kingdom | 109/18 |

*Primary Examiner*—Paul R. Gilliam
*Assistant Examiner*—David H. Corbin

[57] ABSTRACT

A system and a latch mechanism adapted to release a curtain for deployment along one side of a window to protect the latter against burglary. This system comprises a curtain, a latch mechanism releasably holding the curtain and including an actuation bellows, a window having a vacuum space continguous to one face thereof, a fluid line from the vacuum space to the bellows, and a vacuum pump connected to the vacuum space, whereby a loss of vacuum in the latter will expand the bellows and then triggers the latch mechanism and thus releases the curtain which deloys itself under gravity to shield the window. The latch mechanism comprises a latch finger rotatable about its longitudinal axis and including a latch pin portion pivoted at one end about a transverse axis to freely drop to a downwardly hanging released position upon appropriate rotation of the latch finger.

5 Claims, 5 Drawing Figures

ANTI-BURGLAR WINDOW SHIELDING SYSTEM AND LATCH MECHANISM THEREFOR

This invention relates to an anti-burglar system for window and, more particularly, to a system of the type adapted to be released upon attempted burglary to shield a window against burglar intrusion therethrough and to a latch mechanism for such system.

The systems of the above type which have been proposed so far are electrically operated by breaking of the associated window. Such systems of the electric type may be relatively easily tampered with by simply cutting off the power.

It is a general object of this invention to provide an anti-burglar window shielding system wherein the mere de-energization thereof will not defeat its defensive action but will rather trigger it.

It is a more specific object of the present invention to provide an anti-burglar window shielding system which operates upon loss of vacuum in a space contiguous to one face of a window, such as between spaced-apart panes, such that the de-energization of the associated vacuum pump will also result in anti-burglar shielding action by the system.

It is another object of the present invention to provide a latch mechanism which is advantageously adapted to release a shielding curtain for deployment thereof along one side of a window but which is also adapted for other latching applications.

The above and other objects and advantages of the present invention will be better understood with the following detailed description of a preferred embodiment thereof which is illustrated, by way of example, in the accompanying drawings, wherein.

Figure 1:
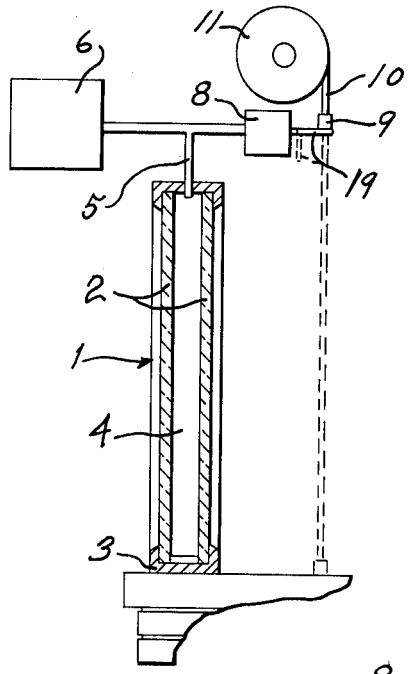
FIG. 1 is a schematic elevation view illustrating a window shielding system according to the present invention.
Figure 2:
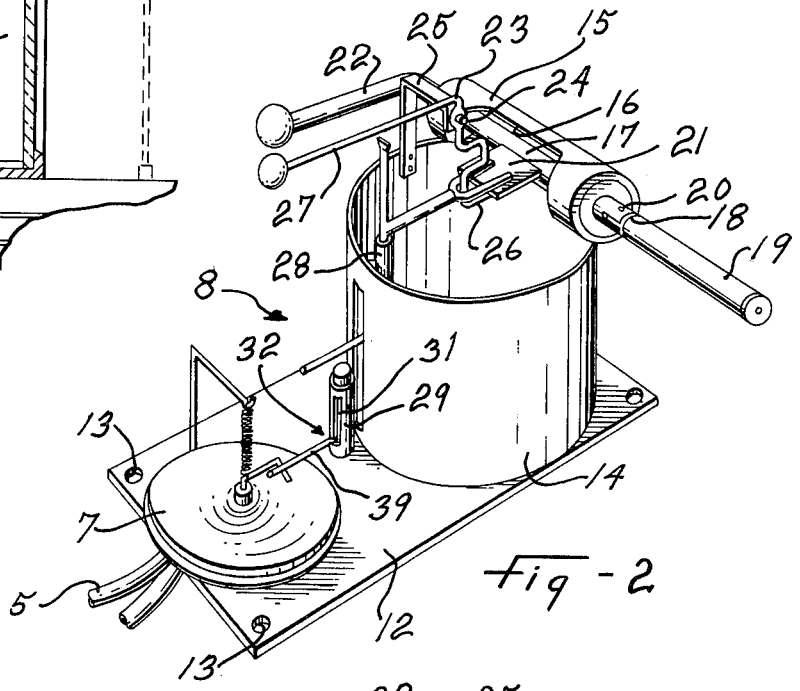
FIG. 2 is a perspective view of a latch mechanism forming part of the system of FIG. 1.
Figure 3:
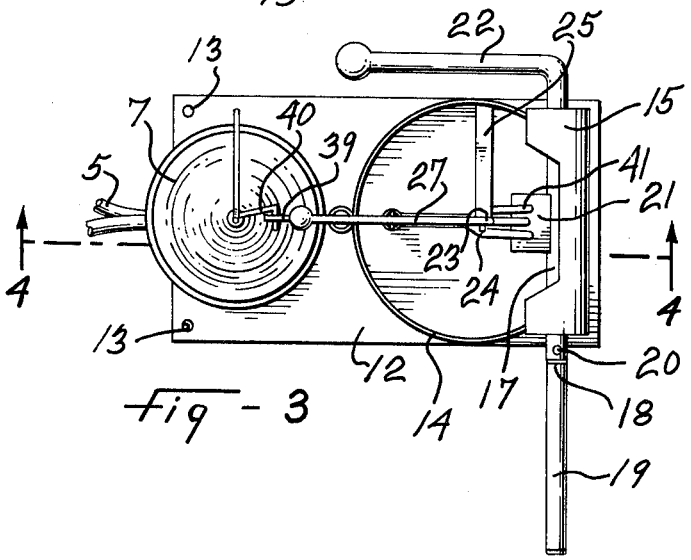
FIG. 3 is a top plan view of the latch mechanism of FIG. 2.

The illustrated anti-burglar window shielding system comprises a window 1, such as a show window, including a pair of laterally spaced-apart panes 2 held by a frame 3 forming an airtight space 4 between the panes. A fluid line 5 communicates at one end with the airtight space 4 of the window 1 and at the other end with a vacuum pump 6, an exit and a bellows 7, the latter forming part of a latch mechanism 8. This latch mechanism includes a latch pin adapted to intercept the weighted edge 9 of a shielding curtain 10 deployable under gravity which is inoperatively held by the latch pin in a roll 11 extending lengthwise across the width of the window 1 at the top of the latter. Obviously, the release of the afore-mentioned latch pin will allow deployment or unrolling of the shielding curtain 10 under gravity, such that the latter will deploy to shield the entire surface of the window on the external side of the latter, as shown by the dotted lines in FIG. 1. The shielding curtain 10 is preferably made of interconnected metal links, as known, to form an effective barrier against burglary.

The latch mechanism 8 will now be described in detail with reference to FIGS. 2 to 4*a* inclusive. The latch mechanism 8 includes a baseplate 12 adapted to be horizontally fixed on a structural member at the top of the window, such as by screws fixed in the holes l3. A tubular support 14 is secured endwise onto the baseplate 12. A tubular member 15 having a cutout 16 is rigidly secured on top of the tubular support 14 and extends transversely of the latter with the cutout 16 directed laterally toward the top opening of the tubular support and toward the bellows 7 secured on the baseplate 12.

A latch finger is rotatably mounted in the tubular member 15 about the longitudinal axis of the latter. This latch finger includes a spindle 17 or root portion providing the rotation about the longitudinal axis in the tubular member 15. The latch finger also includes a latch pin portion formed by a journal portion 18 and a sleeve 19 rotatable on the journal portion 18. The latter, and thus the latch pin portion as a whole, are pivoted at one end on an external end of the spindle 17 about an axis extending transversely of the longitudinal axis of the latch finger or spindle 17, as indicated by the pin 20. Preferably, the sleeve 19 is mounted on bearings relative to the journal portion 18 to facilitate the aforementioned rotation about the longitudinal axis.

The spindle 17 is provided with a radial projection 21 projecting outwardly through the cutout 16 and is also provided with an arm 22 which laterally weights the spindle relative to its axis to rotatively bias the spindle toward alignment of the pin 20 with the horizontal. A catch device, to be hereinafter described, is provided to catch the radial projection 21 and hold the latch finger in latched position. The catch device includes a crank lever 23 pivoted on a pin 24 secured to a bracket 25 attached to the tubular support 14. Thus, the crank lever 23 is pivotable about an axis extending parallel to the spindle 17. One arm of the crank lever forms a catching hook 26 and the other arm forms an actuation arm 27.

A trigger device is provided to actuate the catch device and includes a first and a second tubular guideways 28 and 29 having guide slots 30 and 31 therein respectively. The guide slot 31 is formed with a cocking notch, as shown at 32 in FIG. 2. A plunger 33 is upwardly slidable in the tubular guideway 28 and adapted to strike the actuation arm 27 when upwardly projected, as shown by the arrows 34 in FIG. 4*a*. The plunger 33 has a radial arm 35 outwardly projecting through the upright slot 30 of the tubular guideway 28 and an upright slot 36 in the tubular support 14. A plunger 37 is upwardly slidable in the tubular guideway 29 and is upwardly biased by a spring 33 at the bottom of this tubular guideway. The plunger 37 has a radial arm 39 outwardly projecting through the upright guide slot 31 of the tubular guideway 29.

An actuating arm, or wire 40, is secured to the bellows 7 to be upwardly displaced by the latter. The arm 40 has an inclined free end adapted to dislodge the radial arm 39 from the cocking notch of the slot 31 upon expansion of the bellows. This expansion occurs upon breaking of at least one pane 2 and the resultant loss of vacuum in the space 4.

Figure 4:
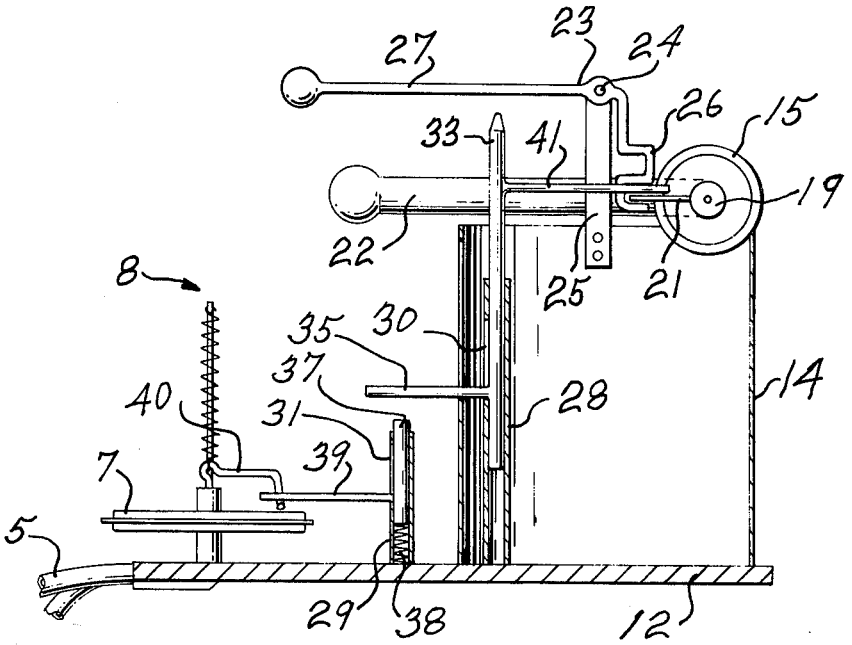
FIG. 4 is a cross-sectional view as seen along line 4—4 in FIG. 3 and showing the mechanism in latching position.
Figure 4A:
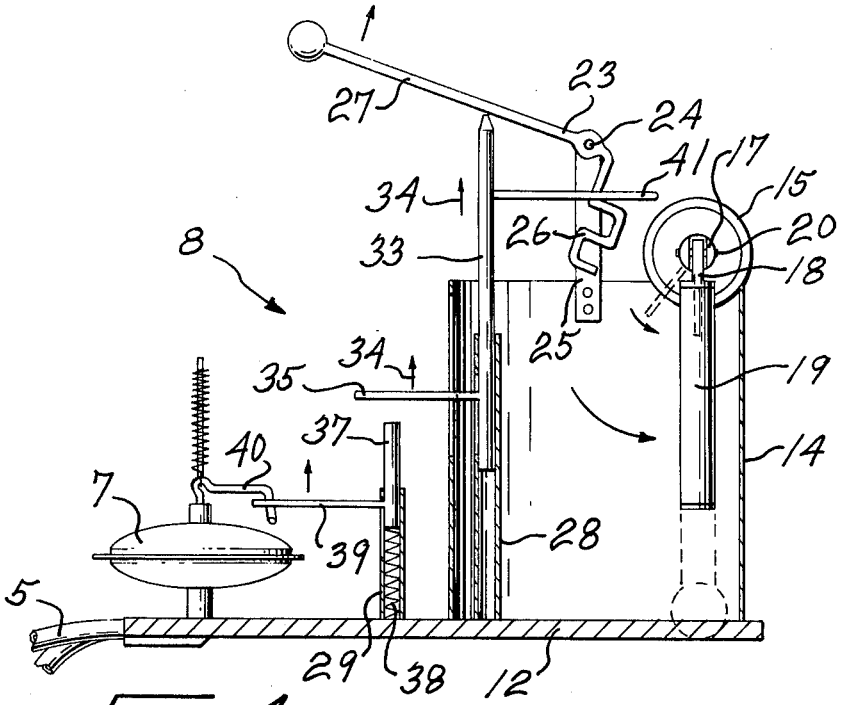
FIG. 4*a* compares to the view of FIG. 4 but with the mechanism in released or unlatched position.

The release of the arm 39 from the cocking notch allows the spring 38 to upwardly propel the plunger 37 which strikes the arm 35 and throws the plunger 33 against the actuation arm 27. A guide fork 41 radially projecting from the plunger 33 operatively straddles the catching hook 26 to guide the latter. The upward pivoting of the actuation arm 27 produces disengagement of the catching hook 26 from the radial projection 21. The weight of the radial arm 22 then pivots the latch finger about the longitudinal axis thereof toward horizontal alignment of the transverse axis defined by the pin 20. The latch pin portion including the sleeve 19 then pivotally drops to a downwardly hanging released position, as shown in FIG. 4*a* and in dotted line in FIG. 1. The shielding curtain 10 is thus released and allowed to deploy in front of the window.

It must be noted that the window may be a different type, such as, for instance, of the single pane type, in which case the required vacuum space, to replace space 4, could be formed by a tubular passage in the glass of the pane. Obviously, the present invention is not to be restricted to any specific window construction anymore than specified by the appended claims.

I claim:

1. An anti-burglar shielding system comprising a window having a fluid-tight space formed against one face thereof and capable of communicating with atmospheric air upon breakage of said window, a bellows, a fluid line connecting said bellows with said space, a vacuum pump means communicating with said space to produce at least a partial vacuum in the latter and in said bellows to maintain said bellows in contracted position, said bellows taking an expanded position when communicating with atmospheric air upon breakage of said window, a window shielding curtain mounted across the top of said window, held in a roll when in inoperative position and deploying to an operative window shielding position on one side of said window under the action of gravity and a latch device to hold said shielding curtain in rolled-up inoperative position and operable by expansion of said bellows to release said shielding curtain and allow gravity to deploy said curtain to its window shielding position, said latch device comprising a support, a cylindrical latch finger including a root portion and a latch pin portion freely pivotably connected at one end to the root portion about a transverse pivot relative to the longitudinal axis of the latch finger, said transverse pivot carried by said root portion, said root portion rotatably journalled in said support and extending substantially horizontally, said latch pin portion retained in a substantially horizontal latching position coaxial with said root portion and overhanging from said support, when said transverse pivot is upright in a first rotated position of said root portion, and taking a downwardly hanging release position when said transverse pivot is substantially horizontal in a second rotated position of said root portion, said latch pin portion, when in said latching position, underlying a portion of said shielding curtain when in rolled-up position and constituting a stop holding said shielding curtain in said rolled-up position, said latch pin portion, when in said downwardly hanging release position, releasing said shielding curtain to deploy under gravity, means biasing said root portion to its second rotated position, a catch device releasably holding said root portion in its first rotated position, wherein said transverse pivot is upright, and a trigger device actuated by expansion of said bellows to operate said catch device to cause the latter to release said root portion and allow its rotation to its second rotated position under the action of said biasing means.

2. An anti-burglar shielding system as defined in claim 1, wherein said root portion has a radial projection and said catch device has a catching hook engageable with said radial projection to hold said root portion in its first rotated position.

3. An anti-burglar shielding system as defined in claim 2, wherein said biasing means include a weight carried by said root portion and radially offset from the rotational axis of said root portion.

4. An anti-burglar shielding system as defined in claim 3, wherein said catch device includes a crank lever pivoted intermediate the opposite arms thereof about an axis extending transversely of the plane thereof and longitudinally of said longitudinal axis, one arm of said crank lever constitutes said catching hook releasably catching said radial projection and said trigger device operatively engages the other arm of said crank lever and is constructed and arranged to release said catching hook from engagement with said radial projection.

5. An anti-burglar shielding system as defined in claim 4, wherein said bellows has a releasing finger displaceable therewith, said trigger device includes a first plunger guideway defining a guide slot extending longitudinally thereof and forming a cocking notch at one end thereof, a spring-loaded plunger mounted in said guideway and having an actuation finger radially projecting therefrom through said guide slot and engaging said cocking notch to cock said plunger against the action of its spring, said actuation finger intercepting said releasing finger, the latter releasing said actuation finger from said cocking notch upon expansion of said bellows, said plunger then movable under action of its spring to cause pivoting of said crank lever to release said catching hook from engagement with said radial projection.

* * * * *